US006240607B1

(12) United States Patent
McCrary

(10) Patent No.: US 6,240,607 B1
(45) Date of Patent: Jun. 5, 2001

(54) SHOE STRING RETAINING DEVICE

(76) Inventor: Patrina McCrary, 1324 SW. Ave. D, Belle Glade, FL (US) 33430

( * ) Notice: Subject to any disclaimer, the term of this patent is extended or adjusted under 35 U.S.C. 154(b) by 0 days.

(21) Appl. No.: 09/487,519

(22) Filed: Jan. 19, 2000

(51) Int. Cl.[7] ..... F16G 11/00
(52) U.S. Cl. ..... 24/712.1; 24/130
(58) Field of Search ..... 24/712.1, 712.4, 24/129 R, 115 R, 712.3, 712.6, 712.7, 712.9, 265 AL, 122.6, 130, 131 C; 36/50.1; 403/213, 369, 365, 334, 251; 294/82.14, 74

(56) References Cited

U.S. PATENT DOCUMENTS 528,464 * 10/1894 Craig .
1,094,262 * 4/1914 Spangenberg ..... 24/130 X
1,315,860 * 9/1919 Polouboyarenof .
3,345,707 * 10/1967 Rita .
4,258,456 * 3/1981 Thurston et al. ..... 24/712.7
4,805,270 * 2/1989 Kimbrough ..... 24/712.3
4,884,321 * 12/1989 Holub ..... 24/712.6
5,022,127 * 6/1991 Ang ..... 24/712.2
5,467,511 * 11/1995 Kubo ..... 24/712.9
5,535,531 * 7/1996 Karabed et al. ..... 36/50.1
5,649,342 * 7/1997 D'Andrade et al. ..... 24/712.2
5,671,517 * 9/1997 Gourley ..... 24/712.1
5,873,183 * 2/1999 Posner ..... 36/50.1

* cited by examiner

*Primary Examiner*—Robert J. Sandy
(74) *Attorney, Agent, or Firm*—John D. Gugliotta

(57) ABSTRACT

A shoe string retaining device is provided having a connection eyelet forming a flat ring connected to a lower retaining tube affixed horizontally. The lower retaining tube forming a tapered interior sidewall having a lace entry orifice formed at one end and opposite a lace exit and impingement orifice.

4 Claims, 2 Drawing Sheets

SHOE STRING RETAINING DEVICE

BACKGROUND OF THE INVENTION

1. Field of the Invention

The present invention relates generally to shoes and shoelaces and, more particularly, to a shoe string retaining device for use with any conventionally laced shoe.

2. Description of the Related Art

In the related art, many attempts are known for restraining and containing the loose ends of shoe strings. For example, U.S. Pat. No. 5,467,511 issued in the name of Kubo, U.S. Pat. No. 4,258,456 issued in the name of Thurston et al., U.S. Pat. No. 3,345,707 issued in the name of Rita, and U.S. Pat. No. 528,464 issued in the name of Craig each disclose a shoelace fastening device mounted on the instep of the shoe.

Also, U.S. Pat. No. 4,884,321 issued in the name of Holub and U.S. Pat. No. 1,315,860 issued in the name of Polouboyarenof describe a shoe lace end grip and locking device.

U.S. Pat. No. 5,873,183 issued in the name of Posner discloses a shoe securement apparatus with lace and groove fasteners.

U.S. Pat. No. 5,671,517 issued in the name of Gourley describes a shoe lace safety guard to cover and retain.

U.S. Pat. No. 5,649,342 issued in the name of D'Andrade discloses a decorative device for attaching to and securing of shoelaces.

U.S. Pat. No. 5,022,127* issued in the name of Ang describes a shoelace locking device comprised of an elastic hinge and cover.

U.S. Pat. No. 4,805,270* issued in the name of Kimbrough discloses jaw members attached to a shoe to secure laces after tying.

While the general functionality these inventions as well as in other related references is accomplished by the present invention, other elements in combination are different enough as to make the combination distinguished over these related references.

SUMMARY OF THE INVENTION

Therefore, it is an object of the invention to indicate a device of the type disclosed above which avoids the disadvantages inherent in the state of the art. In particular, the device is to prevent shoelaces from coming undone.

It is a feature of the present invention to provide a shoe string retaining device that attaches to the shoe via the shoelaces themselves and preventing the lace ends from dragging on the ground.

Briefly described according to the preferred embodiment of the present invention, a shoe string retaining device is provided having a connection eyelet forming a flat ring connected to a lower retaining tube affixed horizontally. The lower retaining tube forming a tapered interior sidewall having a lace entry orifice formed at one end and opposite a lace exit and impingement orifice.

An advantage of the present invention includes that it keeps the laces tied, thus preventing a user from repeatedly stopping and retying them.

Another advantage of the present invention includes that it prevents a falling hazard as would result from tripping on untied laces.

Yet another advantage of the present invention includes that it keeps the laces and the lace ends in a like new condition by preventing one from walking on them.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
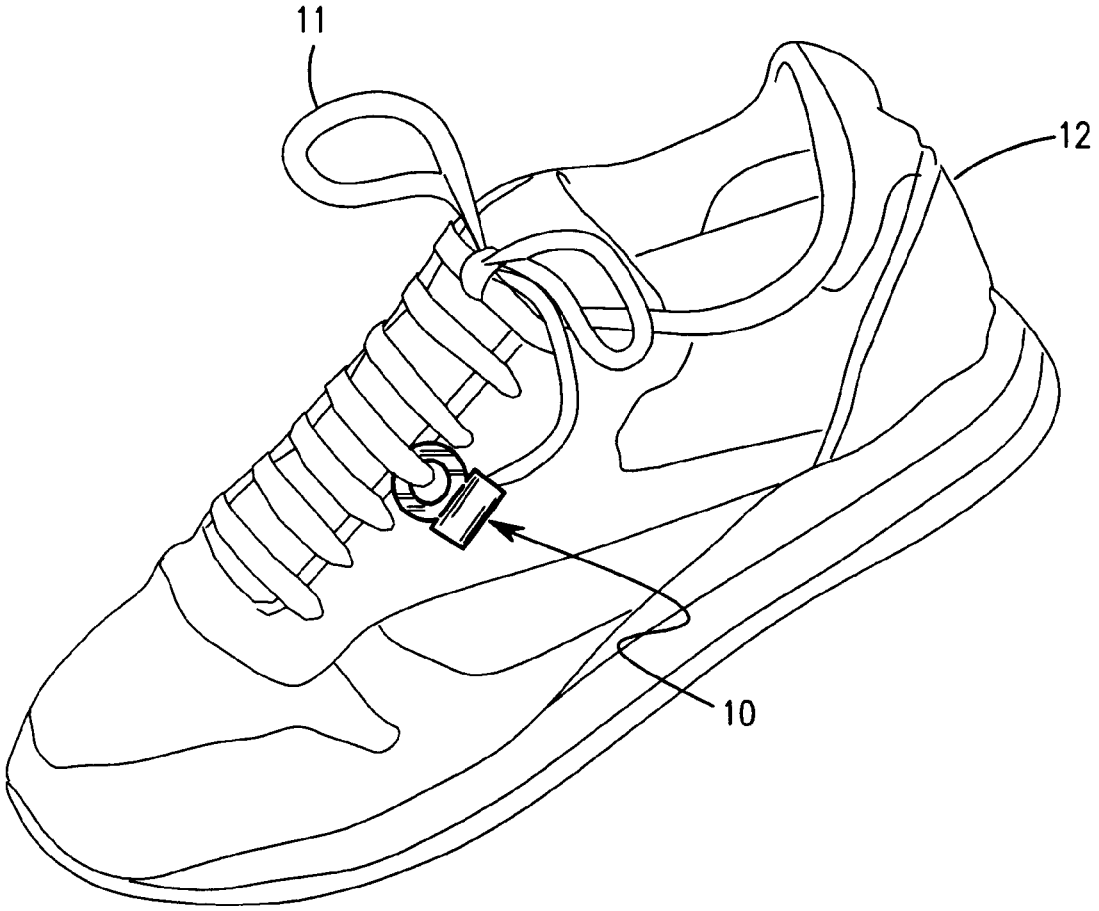
FIG. 1 is a perspective view of a shoe lace retaining device according to the preferred embodiment of the present invention, shown attached to a conventional laced shoe.
Figure 2:
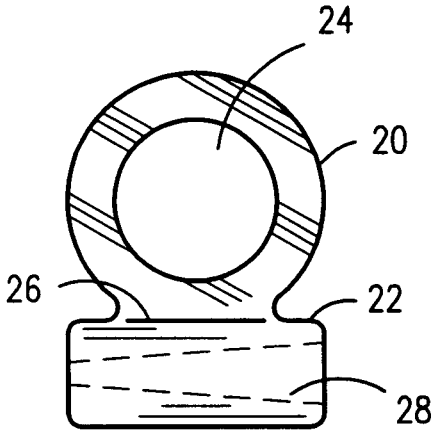
FIG. 2 is a top plan view thereof.
Figure 3:
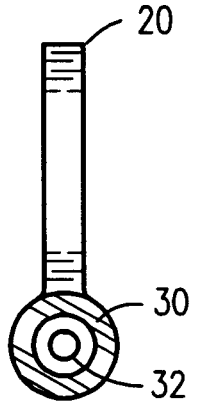
FIG. 3 is a front elevational view thereof.
Figure 4:
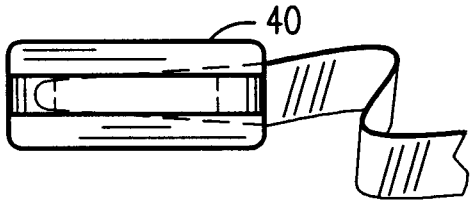
FIG. 4 is a right side elevational view thereof.
Figure 5:
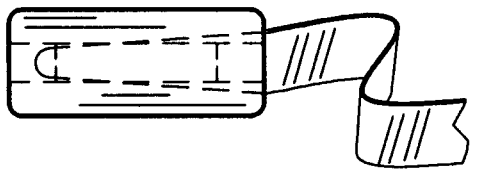
FIG. 5 a left side elevational view thereof.

Referring now to FIG. 1, a shoe string retaining device 10 is shown, according to the present invention, retaining a conventional shoelace 11 used to secure an otherwise conventional shoe 12.

In greater detail shown in FIG. 2–5, the shoe string retaining device 10 is formed of a bifurcated, dual lobed configuration having an upper connection eyelet 20 above a lower retaining tube 22. The connection eyelet 20 is formed of a flat ring that forms a connection orifice 24 that is designed to circumscribe a conventional shoe lace in the manner described in greater detail below. Along the lower quadrant of the connection eyelet 20 is a lower attachment arc 26 to which the retaining tube 22 is connected in a radially aligned manner to the connection eyelet 20.

The lower retaining tube 22 is formed as a generally horizontally elongated cylindrical housing 40 forming a tapered interior sidewall 28, and forming a lace entry orifice 30 at the entrance of the retaining tube 22 opposite a lace exit and impingement orifice 32.

2. Operation of the Preferred Embodiment

In accordance with a preferred embodiment of the present invention, as shown in FIG. 1–5, the connection eyelet 20 is laced to circumscribe a conventional shoelace 11 such that the flat ring is pulled tight against the surface of the shoe 12 in an unobstructed manner. As such, the lower attachment arc is directed in the downward direction such that access to the retaining tube can be easily obtained. With the lower retaining tube 22 placed horizontally as such with the lace entry orifice rearward facing and the lace exit and impingement orifice forward facing, the user can, after tying conventionally, place the tip of the lace into the lace entry orifice and threaded through the retaining tube such that the end penetrates the narrowed lace exit and impingement orifice 32. The exit orifice created by the lace exit and impingement orifice 32 will physically impinge against the lace 11 by frictional impingement, thereby retaining the loose end of the shoelace in a convenient, safe manner.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A shoelace tip retaining device comprising:

a connection eyelet forming a flat ring capable of circumscribing a shoelace and being pulled tight against a surface of a shoe, said connection eyelet having a lower attachment arc directed in the downward direction:

a lower retaining tube affixed to said lower attachment arc horizontally, said lower retaining tube forming a tapered interior sidewall;

a lace entry orifice formed at one end of said lower retaining tube; and a lace exit and impingement orifice formed opposite said lace entry orifice.

2. The shoelace tip retaining device of claim 1, wherein said lace exit and impingement orifice forms an opening of smaller diameter than said lace entry orifice.

3. A method for retaining shoelace tips using a shoelace tip retaining device having a connection eyelet forming a flat ring connected to a lower retaining tube affixed to a lower attachment horizontally, providing a lace entry orifice and a lace exit orifice, with said lace exit orifice narrower than said lace entry orifice, wherein said shoe string retaining device is laced to circumscribe a shoelace such that the flat ring is pulled tight against the surface of the shoe, whereby after tying the shoe, the shoelace tip is placed into the lace entry orifice and threaded through the retaining tube such that the shoelace tip penetrates the narrowed lace exit and impingement orifice.

4. A shoelace tip retaining device for use with a laced shoe comprising:

a cylindrical tube having first and second generally circular orifices and a tapered bore therethrough;

said first orifice having a diameter larger than said shoelace tip to facilitate insertion of said tip into said tube; and said second orifice being coaxial with and smaller than said shoelace tip such that a shoelace tip when inserted axially into said tube through said first orifice directed toward said second orifice will become frictionally engaged within said tube intermediate said first and second orifices, thereby preventing said shoelace tip from falling out of said tube when the shoe is worn, but may be deliberately pulled therefrom for untying said shoe; and a flat ring connected to said tube having an aperture for threading a shoelace therethrough, thereby removably securing said retaining device to the exterior surface of the shoe with which it is being used.

* * * * *